US009227316B2

(12) United States Patent
Stevens

(10) Patent No.: US 9,227,316 B2
(45) Date of Patent: Jan. 5, 2016

(54) TOOL BOX

(71) Applicant: Michael Stevens, Conway, SC (US)

(72) Inventor: Michael Stevens, Conway, SC (US)

( * ) Notice: Subject to any disclaimer, the term of this patent is extended or adjusted under 35 U.S.C. 154(b) by 90 days.

(21) Appl. No.: 14/099,902

(22) Filed: Dec. 6, 2013

(65) Prior Publication Data

US 2015/0158173 A1 Jun. 11, 2015

(51) Int. Cl.
*B65D 85/28* (2006.01)
*B25H 3/02* (2006.01)

(52) U.S. Cl.
CPC ..... *B25H 3/022* (2013.01)

(58) Field of Classification Search
USPC ..... 206/372, 373, 349
See application file for complete search history.

(56) References Cited

U.S. PATENT DOCUMENTS

| | | | | | |
|---|---|---|---|---|---|
| 4,768,651 | A * | 9/1988 | Lanius | 206/315.11 |
| 5,069,342 | A * | 12/1991 | Dickinson | 206/372 |
| 5,114,007 | A * | 5/1992 | Chen | 206/373 |
| 5,680,932 | A * | 10/1997 | Dickinson et al. | 206/372 |
| 5,826,719 | A * | 10/1998 | Chen | 206/373 |
| 6,193,062 | B1 * | 2/2001 | Rysgaard et al. | 206/315.11 |
| 7,121,407 | B2 * | 10/2006 | Hurt et al. | 206/373 |
| 7,322,470 | B2 * | 1/2008 | Brunson | 206/372 |
| 2002/0117414 | A1 * | 8/2002 | Kipper et al. | 206/373 |
| 2002/0125159 | A1 * | 9/2002 | Hann | 206/372 |
| 2004/0069668 | A1 * | 4/2004 | Finnigan | 206/372 |

* cited by examiner

*Primary Examiner* — Jacob K Ackun

(57) ABSTRACT

A tool box has a lower section, with drawers and a horizontal storage compartment, and an upper section, with vertical storage compartments. The upper section compartments can be arranged in variable sizes through the use of inserted dividers, thus providing a unique space for each tool. A flag can be disposed so that when a tool is removed from its unique space, the flag is easily visible to show that the tool is missing. The tool box can eliminate clutter, organize tools and prevent misplacement and loss of tools.

5 Claims, 4 Drawing Sheets

FIG. 6
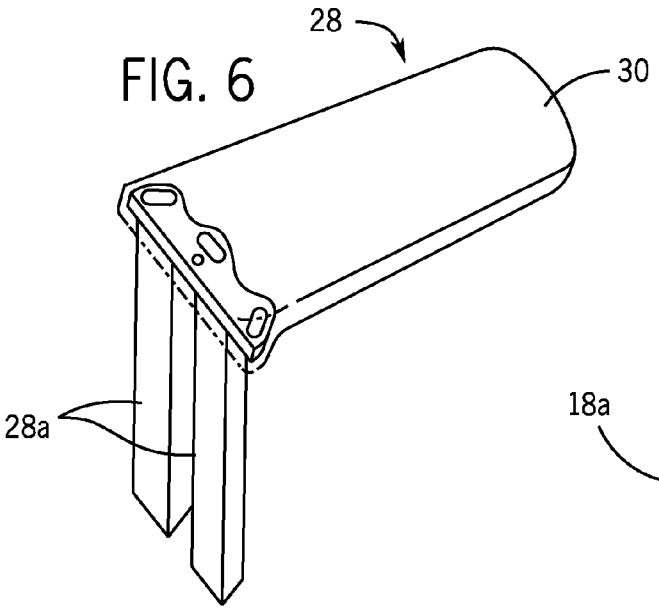
FIG. 7
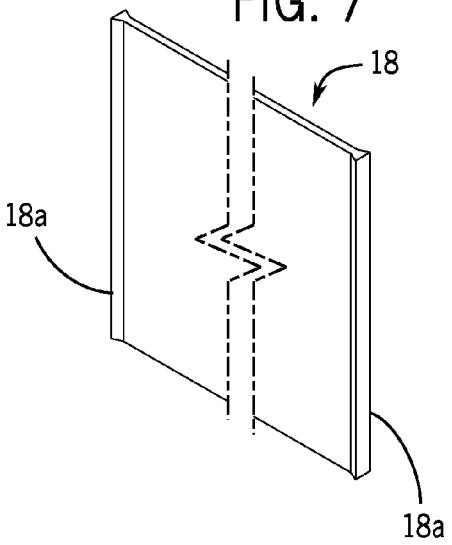
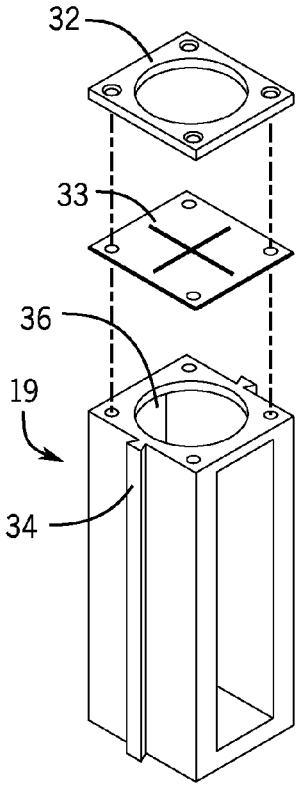
FIG. 8
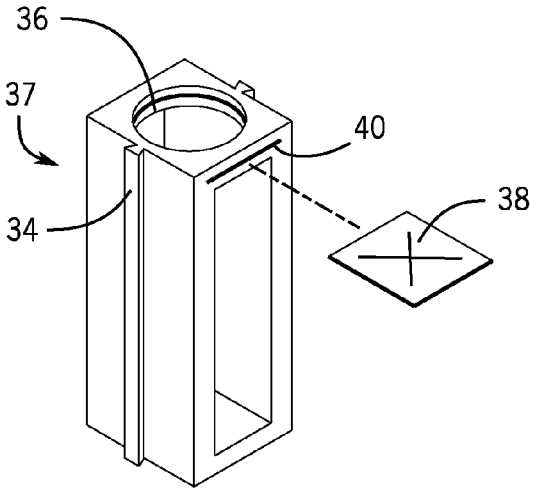
FIG. 9

TOOL BOX

BACKGROUND OF THE INVENTION

The present invention relates to tool boxes and, more particularly, to a tool box that makes organizing and keeping track of tools easy.

Most tool boxes feature a large open area where tools are often piled on top of each other. Tool boxes often become cluttered with a pile of tools, making it frustrating to find the desired tool. Also, tools can easily be misplaced or lost because a user doesn't realize when one is missing until it is needed once again.

While some conventional tool boxes have small slots placed around the large open area, these slots are formed in pre-determined sizes and may not be useful to a specific user.

As can be seen, there is a need for a tool box that can easily organize and keep track of tools.

SUMMARY OF THE INVENTION

In one aspect of the present invention, a tool box comprises a lower compartment having a plurality of drawers extending from one or more sides thereof; an upper compartment disposed atop the lower compartment; a plurality of integral interior walls dividing the upper compartment into multiple tool storage compartments; receivers disposed along opposite sides of the multiple tool storage compartments; and dividers operable to fit into the receivers to create adjustably-sized tool storage compartments.

In another aspect of the present invention, a tool box comprises a lower compartment having a plurality of drawers extending from one or more sides thereof; an upper compartment disposed atop the lower compartment; a plurality of integral interior walls dividing the upper compartment into multiple tool storage compartments; receivers disposed along opposite sides of the multiple tool storage compartments; dividers operable to fit into the receivers to create adjustably-sized tool storage compartments; a plurality of flags disposed over each of the adjustably-sized tool storage compartments when a tool is missing therefrom, the flags being resiliently bent into the adjustably-sized tool storage compartments when the tool is disposed therein; a fixed horizontal divider disposed between the lower compartment and the upper compartment; and a handle extending from the upper compartment.

These and other features, aspects and advantages of the present invention will become better understood with reference to the following drawings, description and claims.

BRIEF DESCRIPTION OF THE DRAWINGS

FIG. 6 is a perspective view of a tool removed flag used in the tool box of FIG. 1;

FIG. 7 is a perspective view of a divider used to divide compartments of the tool box of FIG. 1;

FIG. 8 is an exploded perspective view of a vertical storage compartment used with the tool box of FIG. 1; and FIG. 9 is an exploded perspective view of another vertical storage compartment used with the tool box of FIG. 1.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tool box that has a lower section, with drawers and a horizontal storage compartment, and an upper section, with vertical storage compartments. The upper section compartments can be arranged in variable sizes through the use of inserted dividers, thus providing a unique space for each tool. A flag can be disposed so that when a tool is removed from its unique space, the flag is easily visible to show that the tool is missing. The tool box can eliminate clutter, organize tools and prevent misplacement and loss of tools.

Figure 1:
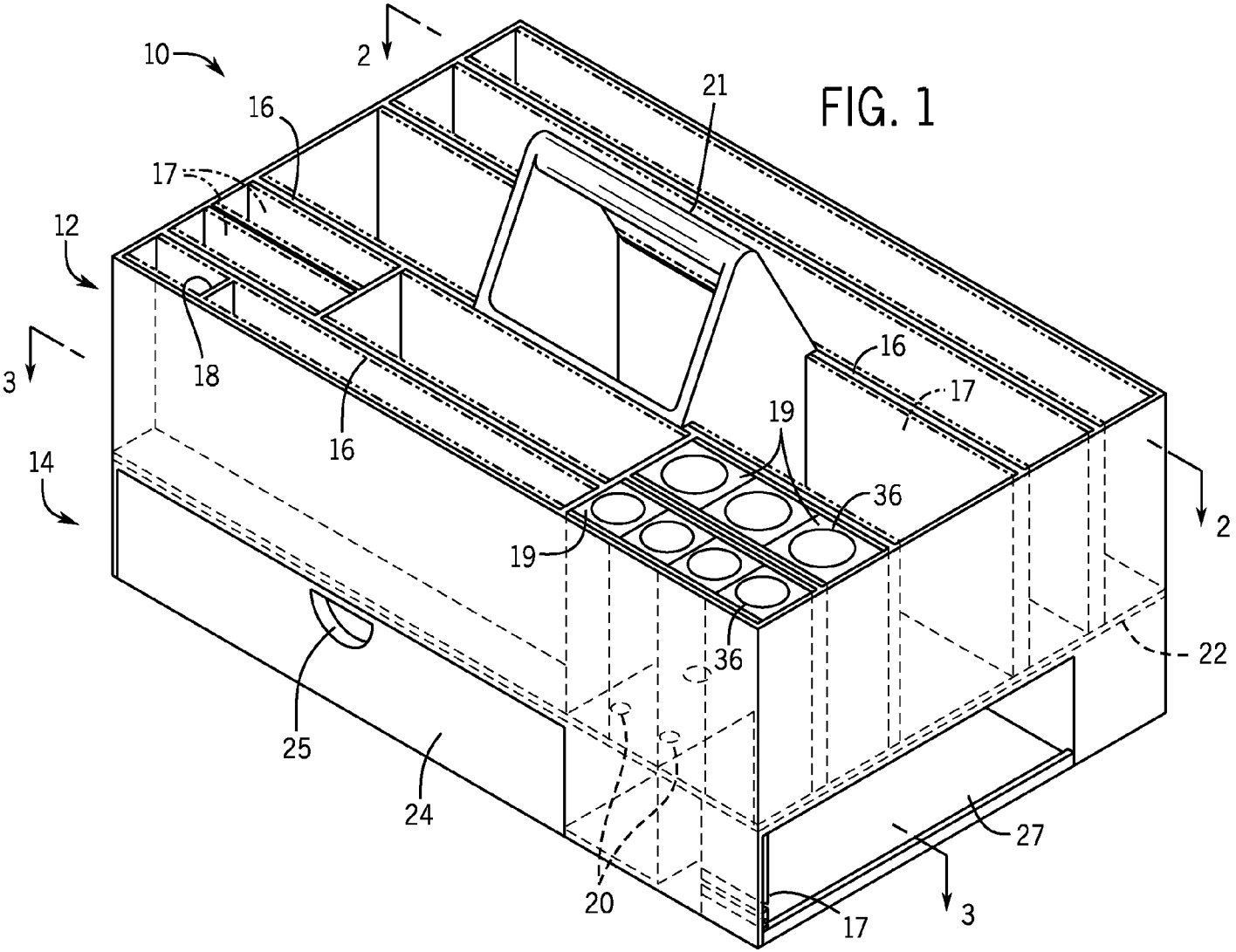
FIG. 1 is a perspective view of a tool box according to an exemplary embodiment of the present invention.
Figure 2:
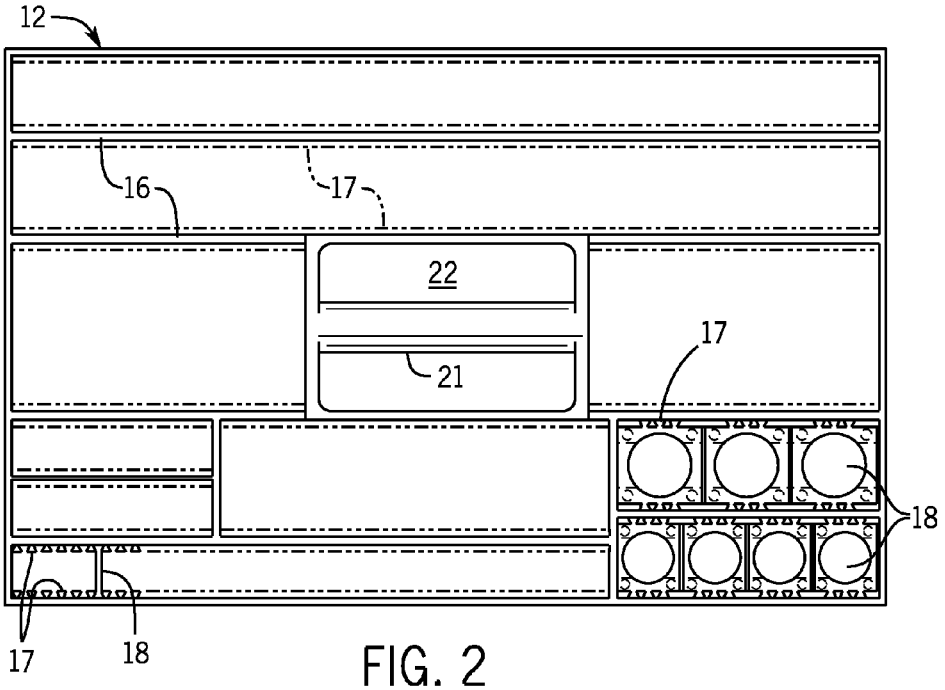
FIG. 2 is a top view of the tool box of FIG. 1, taken along line 2-2 of FIG. 1.
Figure 3:
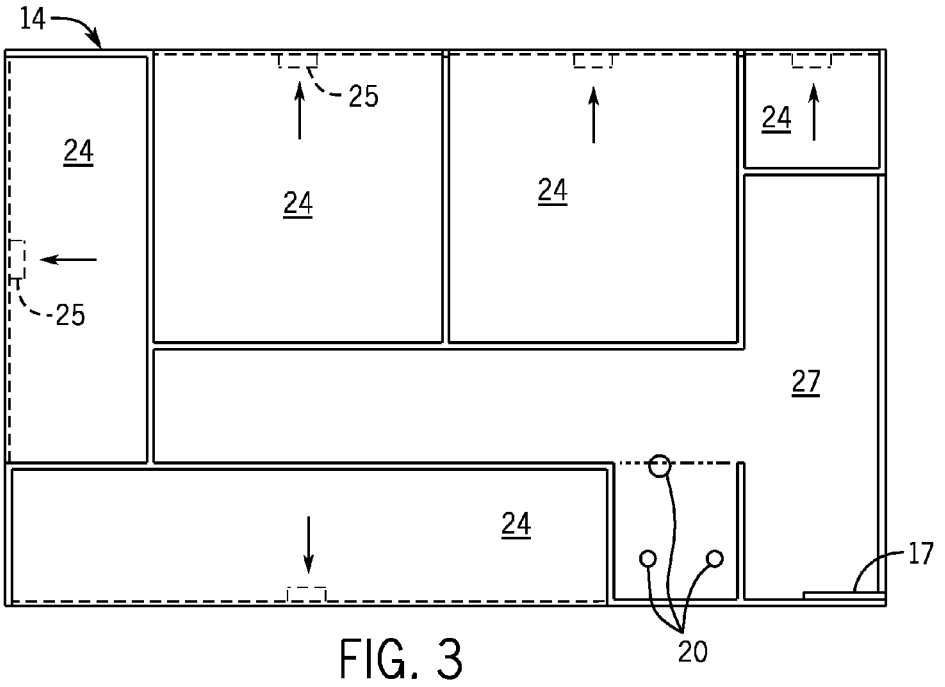
FIG. 3 is a top view of the tool box of FIG. 1, taken along line 3-3 of FIG. 1.

Referring to FIGS. 1 through 3, a tool box 10 includes an upper compartment area 12 disposed on top of a lower compartment area 12. A fixed horizontal divider 22 can be disposed between the upper compartment 12 and the lower compartment 14. In some embodiments, the horizontal divider 22 can be the bottom portion of the upper compartment area 12. In other embodiments, the horizontal divider 22 can be a separate member separating the upper compartment 12 from the lower compartment 14.

A handle 21 can be centrally disposed to allow a user to easily carry the tool box 10. While the Figures show the handle 21 located across a portion of a central area of the tool box 10, various designs for the handle are contemplated within the scope of the present invention. For example, the handle 21 can extend entirely along the top, from side to side, of the tool box 10. In some embodiments, the region below the handle 21 can be designed as a storage compartment for tools.

The upper compartment area 12 can include a plurality of integral dividers 16 that divide the tool box 10 into discrete fixed compartments. Typically, these fixed compartments span the length of the tool box 10, or at least a portion thereof.

A plurality of receivers 17 can be formed along the sides of the fixed compartments. A divider 18 can be disposed into the fixed compartments to create a compartment of a desired size to hold a particular tool. The divider 18 can be supported by the plurality of receivers 17. The width of the dividers 18 can be designed to span the width of the fixed compartments and to be held by the receivers 17 on each side of the compartment. The dividers 18 can be moved and adjusted as needed for specific tools. As shown in FIG. 7, the dividers 18 can include dovetails 18*a* for mating with the receivers 17.

Compartments 19 for vertical storage can be placed in the fixed compartments and supported by the receivers 17. The compartments can include top openings 36 for placement of tools. In some embodiments, the fixed horizontal divider 22 can have a hold 20 to permit a tool, such as a screwdriver, to extend therethrough, where the handle of the tool can be supported in the compartment 19. As shown in FIG. 8, the compartment 19 can include dovetails 34 that fit into the receivers 17. A rubber vertical tool holder 33 can be disposed over the opening 36 to help support a tool therein. In the embodiment of FIG. 8, the rubber vertical tool holder 33 can be disposed on top of the compartment 19 and secured with a cap 32. In the embodiment of FIG. 9, the rubber vertical tool holder 38 can be disposed in a slot 40 disposed in a side of the compartment 37. Of course, other tool holder configurations may be included within the scope of the present invention.

Figure 4:
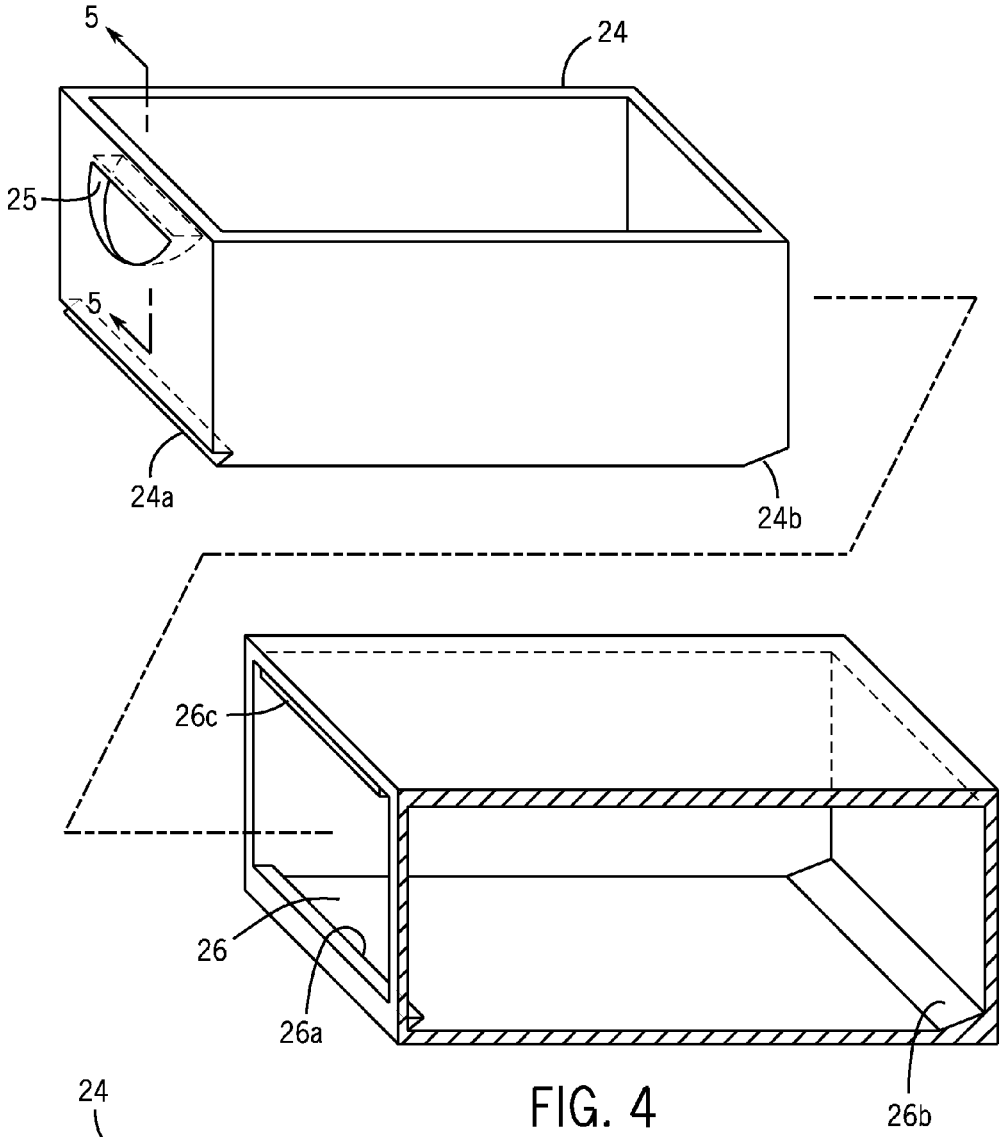
FIG. 4 is an exploded perspective view of a drawer and drawer compartment of the tool box of FIG. 1.
Figure 5:
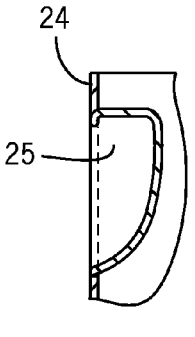
FIG. 5 is a cross-sectional view taken along line 5-5 of FIG. 4.

The lower compartment area 14 can include a plurality of drawers 24 having drawer pulls 25 to provide an area for a user to grasp the drawers 24 and open them. As shown in FIGS. 4 and 5, a drawer compartment 26 can include a catch 26*a*, typically disposed along a bottom side of an opening of the drawer compartment 26. Additionally, the drawer compartment 26 can include a drawer stop 26*c*, typically disposed along a top side of the opening of the drawer compartment 26. A slanted surface 26*b* can be disposed along a bottom side of the drawer compartment 26, opposite the opening therein. The slanted surface 26*b* can mate with a bevel 24*b* of the drawer 24. The drawer 24 can further include a catch 24*a* operable to engage with the catch 26*a* of the drawer compartment 26 to prevent the drawer 24 from being fully pulled out of the drawer compartment 26.

A storage cavity 27 can be disposed between the closed drawers 24. In some embodiments, the storage cavity 27 can be sized and shaped to permit a hammer to be stored therein.

Referring now to FIG. 6, a flag unit 28 can be disposed at one or more of the tool storage locations in the tool box 10. The flag unit 28 can include flag attachment dovetails 28*a* that can made with the receivers 17. The flag unit 28 can include a flag 30 that can bend down with the tool is in the tool box 10, but can be disposed over the storage compartment when the tool is removed. The flag 30 can allow a user to quickly and easily see when a tool is not properly placed in the tool box 10. The flag 30 can be, for example, formed from a brightly colored, rubberized material to quickly and easily indicate that the tool is missing from its compartment.

It should be understood, of course, that the foregoing relates to exemplary embodiments of the invention and that modifications may be made without departing from the spirit and scope of the invention as set forth in the following claims.

What is claimed is:

1. A tool box comprising:

a lower compartment having a plurality of drawers extending from one or more sides thereof;

an upper compartment disposed atop the lower compartment;

a plurality of integral interior walls dividing the upper compartment into multiple tool storage compartments;

receivers disposed along opposite sides of the multiple tool storage compartments;

dividers operable to fit into the receivers to create adjustably-sized tool storage compartments;

vertical storage compartments having dovetails for fitting between the receivers and a rubber vertical tool holder disposed over a top opening of the vertical storage compartments.

2. The tool box of claim 1, further comprising a fixed horizontal divider disposed between the lower compartment and the upper compartment.

3. The tool box of claim 1, further comprising a handle extending from the upper compartment.

4. The tool box of claim 1, further comprising a hammer storage cavity formed in the lower compartment.

5. A tool box comprising:

a lower compartment having a plurality of drawers extending from one or more sides thereof;

an upper compartment disposed atop the lower compartment;

a plurality of integral interior walls dividing the upper compartment into multiple tool storage compartments;

receivers disposed along opposite sides of the multiple tool storage compartments;

dividers operable to fit into the receivers to create adjustably-sized tool storage compartments;

a fixed horizontal divider disposed between the lower compartment and the upper compartment;

a handle extending from the upper compartment;

and vertical storage compartments fitting between the receivers and a rubber vertical tool holder disposed over a top opening of the vertical storage compartments.

* * * * *